US011332814B2

(12) United States Patent
Xu et al.

(10) Patent No.: US 11,332,814 B2
(45) Date of Patent: May 17, 2022

(54) HIGH-STRENGTH AND HIGH-TOUGHNESS MAGNESIUM ALLOY AND PREPARATION METHOD THEREOF

(71) Applicant: CITIC Dicastal CO., LTD., Hebei (CN)

(72) Inventors: Zuo Xu, Qinhuangdao (CN); Kedi Ding, Qinhuangdao (CN); Haibo Qiao, Qinhuangdao (CN); Lixin Huang, Qinhuangdao (CN); Lisheng Wang, Qinhuangdao (CN); Zhendong Zhang, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 237 days.

(21) Appl. No.: 16/508,290

(22) Filed: Jul. 10, 2019

(65) Prior Publication Data

US 2020/0149142 A1 May 14, 2020

(30) Foreign Application Priority Data

Nov. 8, 2018 (CN) ..... 201811321991.8

(51) Int. Cl.

| | |
|---|---|
| ***C22F 1/06*** | (2006.01) |
| ***C22C 1/02*** | (2006.01) |
| ***C22C 23/02*** | (2006.01) |
| ***C22F 1/00*** | (2006.01) |

(52) U.S. Cl.

CPC ..... *C22F 1/06* (2013.01); *C22C 1/02* (2013.01); *C22C 23/02* (2013.01); *C22F 1/002* (2013.01)

(58) Field of Classification Search

None

See application file for complete search history.

(56) References Cited

U.S. PATENT DOCUMENTS

| | | | | |
|---|---|---|---|---|
| 2002/0104593 | A1 | 8/2002 | Pekguleryuz | |
| 2006/0222556 | A1 | 10/2006 | Takumi | |
| 2007/0102072 | A1* | 5/2007 | Kawamura | C22C 23/00 148/666 |
| 2009/0196787 | A1 | 8/2009 | Beals | |
| 2012/0059455 | A1 | 3/2012 | Weber | |

(Continued)

FOREIGN PATENT DOCUMENTS

| | | | |
|---|---|---|---|
| CN | 1401804 | A | 3/2003 |
| CN | 101781728 | A | 7/2010 |

(Continued)

OTHER PUBLICATIONS

Cain T et al: "A Compilation of Corrosion Potentials for Magnesium Alloys", Corrosion, Nace, vol. 70, No. 10, Oct. 1, 2014 ( Oct. 1, 2014), pp. 1043-1051, XP001592187, ISSN: 0010-9312, DOI: 10.5006/1257 [retrieved on May 22, 2014] * table 1 *.

(Continued)

*Primary Examiner* — Brian D Walck

(74) *Attorney, Agent, or Firm* — Syncoda LLC; Feng Ma

(57) ABSTRACT

A high-strength and high-toughness magnesium alloy includes a Mg—Al—Bi—Sb—Zn—Sr—Y—Mn alloy, prepared from the following components in percentage by mass: 7.0 to 10.0% of Al, 0.2 to 2.0% of Bi, 0.2 to 0.8% of Sb, 0.2 to 0.5% of Zn, 0.1 to 0.5% of Sr, 0.03 to 0.3% of Y, 0.05 to 0.1% of Mn and a balance of Mg.

2 Claims, 5 Drawing Sheets

(56) References Cited

U.S. PATENT DOCUMENTS

| | | | | |
|---|---|---|---|---|
| 2014/0044586 | A1* | 2/2014 | Hirai | C22F 1/06<br>420/405 |
| 2017/0106123 | A1 | 4/2017 | Weber et al. | |

FOREIGN PATENT DOCUMENTS

| | | | |
|---|---|---|---|
| CN | 102753715 | A | 10/2012 |
| CN | 103103425 | A | 5/2013 |
| CN | 103290292 | A | 9/2013 |
| CN | 104032196 | A | 9/2014 |
| CN | 104328320 | A | 2/2015 |
| CN | 104630586 | A | 5/2015 |
| CN | 104032196 | B | 12/2015 |
| CN | 105177382 | A | 12/2015 |
| CN | 105420577 | A | 3/2016 |
| CN | 107841667 | A | 3/2018 |
| CN | 108642313 | A | 10/2018 |
| EP | 1685267 | B1 | 9/2007 |
| EP | 2613817 | B1 | 3/2016 |
| KR | 20170076268 | A | 7/2017 |

OTHER PUBLICATIONS

Supplementary European Search Report in the European application No. 19201494.2, dated Jan. 8, 2020.

* cited by examiner (a)

(b)

HIGH-STRENGTH AND HIGH-TOUGHNESS MAGNESIUM ALLOY AND PREPARATION METHOD THEREOF

CROSS-REFERENCE TO RELATED APPLICATIONS

This application claims priority to Chinese Patent Application No. 201811321991.8, filed on Nov. 8, 2018, the contents of which are hereby incorporated by reference in its entirety.

BACKGROUND

A magnesium alloy has the advantages of low density, high specific strength and specific stiffness, good thermal and electrical conductivity, damping vibration attenuation, electromagnetic shielding, ease of processing and molding, ease of recycling and the like. It has an important application value in the fields of automobiles, electronic communications, aerospace, national defense and military and the like and is called the "21st Century Green Engineering Material". At present, various commercial alloy series such as Mg—Al, Mg—Zn, Mg—Re and Mg—Mn have been developed, among which, Mg—Al series magnesium alloys are most widely used thanks to good mechanical properties, corrosion resistance, castability and low cost, and the AZ80 magnesium alloy is relatively widely used, but its performance in strength, plasticity and flame retardant performance needs to be further improved.

An effective way to improve the mechanical properties of the magnesium alloys is alloying. In existing disclosure achievements, the patent CN104032196B invents a high-strength magnesium alloy material and a preparation method thereof. The alloy is prepared from, based on the weight percentage, 4 to 7% of Al, 0.5 to 2.5% of Zn, 1 to 3% of Mn, 0.2 to 0.8% of Li, 0.2 to 1.0% of Zr, less than 1% of Sb, less than 1% of Mo and the balance of Mg. After being subjected to solution treatment and aging treatment, the magnesium alloy has a yield stress reaching 260 MPa or more, a tensile strength reaching 360 MPa and an elongation at break reaching 16% or more. The alloy of this disclosure has good mechanical properties, but the alloy contains an expensive Zr element and a combustible Li element, and the manufacturing process is relatively cumbersome and difficult to operate and realize. The patent CN104328320A discloses a high-strength and high-plasticity magnesium alloy having a tensile strength of 400 MPa or more, a yield strength of 300 MPa or more and an elongation rate of about 8%, and prepared from various components in percentage by mass: 3.0 to 4.5% of Ni, 4.0 to 5.0% of Y, 0.01 to 0.1% of Zr, less than or equal to 0.15% of inevitably impurity elements and the balance of magnesium. This alloy is relatively high in tensile strength, but moderate in plasticity. Meanwhile, the alloy contains a large number of the Y element and the Ni element, which greatly increases the alloy cost and is difficult to apply in large batches. The patent CN103290292A discloses a high-strength magnesium alloy having a yield strength of 350 to 380 MPa, a tensile strength of 410 to 450 MPa and an elongation rate of 6% or more, and prepared from various components in percentage by mass: 1.0 to 15% of Cd, 2.0 to 10.0% of Bi, 5.0 to 13% of Zn, 7.0 to 15.0% of Y, 0.4 to 1.0% of Zr, 0.1 to 5.0% of Nb and less than 0.02% of impurity elements of Si, Fe, Cu, and Ni. A variety of alloying elements and high rare earth content inevitably increase the alloy cost. Meanwhile, in order to guarantee uniform mixing, an alloy ingot blank needs to be prepared by an extra electromagnetic stirring continuous casting method, and thermal treatment of the alloy after deformation further increases the alloy cost.

Therefore, it can be seen that there is an urgent need for a high-strength and high-plasticity magnesium alloy material without rare earth or with a little of rare earth to better meet the requirements of the automobile industry and other industries for high performance of the high-strength magnesium alloy. This will also greatly expand further promotion and application of the magnesium alloys in the future and has great economic and social significance.

SUMMARY

The present disclosure belongs to the technical field of metal materials and processing, and relates to a high-strength and high-toughness wrought magnesium alloy and a preparation method thereof, and more particularly relates to a preparation method of obtaining a high-strength and high-toughness magnesium alloy by microalloying and conditions of corresponding heat treatment processes and extrusion processes.

The present disclosure provides a high-strength and high-toughness wrought magnesium alloy with relatively good flame-retardant effect and a preparation method thereof for defects of an existing magnesium alloy in terms of strength, plasticity and flame retardancy.

The technical solution of the present disclosure is that a high-strength and high-toughness magnesium alloy, namely a Mg—Al—Bi—Sb—Zn—Sr—Y—Mn alloy, is prepared from the following components in percentage by mass: 7.0 to 10.0% of Al, 0.2 to 2.0% of Bi, 0.2 to 0.8% of Sb, 0.2 to 0.5% of Zn, 0.1 to 0.5% of Sr, 0.03 to 0.3% of Y, 0.05 to 0.1% of Mn and the balance of Mg.

A preparation method of the high-strength and high-toughness wrought magnesium alloy includes the following steps:

1) performing mixing: mixing a pure Mg ingot, a pure Al block, a pure Bi block, a pure Sb block, a pure Zn block, a Mg—Y intermediate alloy, a Mg—Sr intermediate alloy and a Mg—Mn intermediate alloy which serve as raw materials according to the magnesium alloy composition;

2) performing smelting: putting the pure Mg ingot into a crucible of a smelting furnace, setting a furnace temperature at 700 to 730° C., maintaining the temperature, and respectively adding the pure Bi block, the pure Sb block and the pure Zn block which are preheated to 50 to 100° C., the Mg—Sr intermediate alloy, the Mg—Y intermediate alloy and the Mg—Mn intermediate alloy which are preheated to 200 to 250° C. into the magnesium melt after the pure Mg ingot is melted; then increasing the smelting temperature by 20 to 40° C., and maintaining the temperature for 5 to 15 minutes, then stirring the mixture for 3 to 10 minutes, reducing the furnace temperature by 10 to 30° C. for refining and degassing treatment, and then standing for heat preservation for 3 to 15 minutes, in which the whole process is performed under the protection of CO2/SF6 mixed gas;

3) performing casting: removing dross from the surface of the melt, and pouring the magnesium alloy melt into a corresponding mold to obtain an as-cast magnesium alloy, in which the casting process does not require gas protection;

4) performing solution treatment: performing solution treatment on the obtained as-cast magnesium alloy at a solution treatment temperature of 415 to 440° C. for 6 to 10 hours, and quenching the alloy with warm water of 30 to 80° C., in which the heating and heat preservation processes of the solution treatment do not require gas protection;

5) performing aging treatment: performing aging treatment on the alloy subjected to the solution treatment, and maintaining the temperature at 175 to 200° C. for 8 to 15 hours; and 6) performing extrusion treatment: extruding the alloy obtained in the step 5) to deform: firstly, cutting a cast ingot into a corresponding blank, and peeling the blank, and then putting the obtained blank into the mold for extrusion deformation treatment at an extrusion deformation speed of 1 to 2.8 m/min, an extrusion ratio of 10 to 50 and an extrusion temperature of 250 to 400° C., in which the deformed blank should be heated to the required extrusion temperature within 30 minutes; and after the extrusion is ended, cooling the alloy at a room temperature.

The present disclosure relates to the high-strength and high-toughness magnesium alloy. On the basis of the Mg—Al binary alloy, trace multielement composite alloying of Bi, Sb, Zn, Sr, Y and Mn elements is used to refine alloy grains and prepare a large-sized Mg17Al12 phase. Meanwhile, the obtained alloy has excellent flame-retardant performance and may realize casting and solution thermal treatment without the gas protection. Furthermore, the rise of a selectable solution treatment temperature substantially reduces the solution treatment time. In addition, new second phases generated by alloying elements and Mg and Al atoms are dispersed on a magnesium matrix, which may effectively pin the movement of a grain boundary, hinder a dislocation motion, strengthen the dispersion and promote dynamic recrystalization of the alloy in a deformation process. After being subjected to casting, thermal treatment and deformation processing, the obtained alloy has good plasticity and toughness. The high-strength and high-toughness wrought magnesium alloy of the present disclosure shows relatively good mechanical properties. The novel alloy shows the relatively good mechanical properties. After the composition is optimized, an aged alloy has a tensile strength reaching about 231 MPa, a yield strength reaching about 118 MPa and an elongation rate of about 10.73%, and an extruded alloy has a tensile strength reaching about 372.5 MPa, a yield strength reaching about 201.4 MPa, an elongation rate of about 25.1% and excellent comprehensive mechanical properties.

The alloy of the present disclosure has good flame retardant performance, may realize casting and thermal treatment without a protective atmosphere in an atmospheric environment, guarantees safety and reliability during work, reduces the environmental pollution during alloy processing, makes the generation and preparation process of a magnesium alloy more environmentally friendly, is suitable for mass production, and has good large-scale application prospects.

The preparation method of the present disclosure is simple in process, safe and convenient to operate. The alloy solution treatment temperature may be increased to 430° C., thereby reducing the solution treatment time by about one time and improving the alloy solution treatment efficiency.

The present disclosure has good flame-retardant performance and may realize casting and solution thermal treatment without gas protection. Furthermore, the rise of a selectable solution treatment temperature substantially reduces the solution treatment time. After being subjected to casting, thermal treatment and deformation processing, the obtained alloy has good plasticity and toughness and has a tensile strength of 372.5 MPa, a yield strength of 201.4 MPa and an elongation rate of 25.1%.

BRIEF DESCRIPTION OF THE DRAWINGS

In order to make the objectives, technical solutions and advantages of the present disclosure clearer, the present disclosure is further described below in combination with the accompanying drawings.

DETAILED DESCRIPTION

Figure 1:
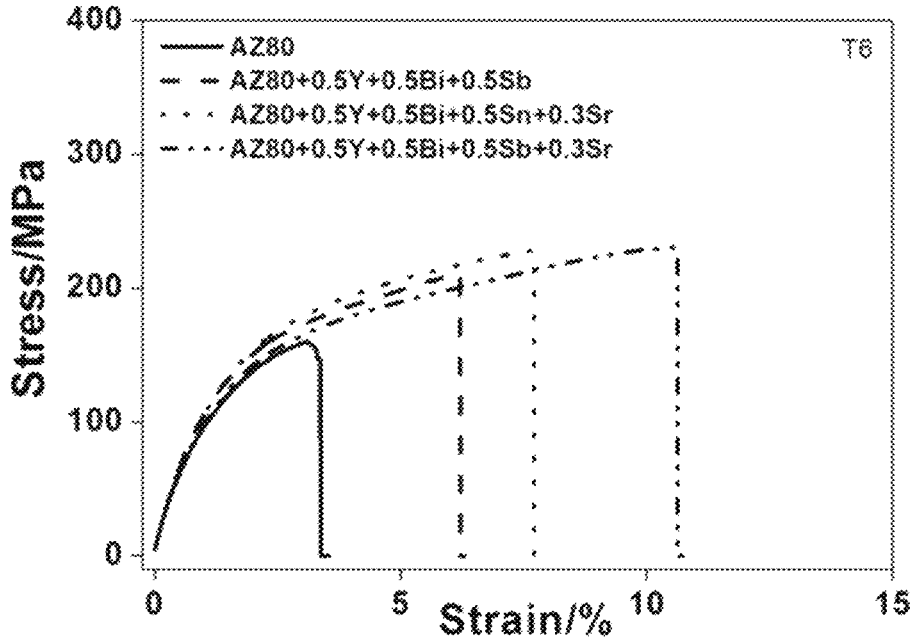
FIG. 1 illustrate mechanical property curves of the materials, in which panel (a) is a T6-state mechanical property curve, and panel (b) is an extruded-state mechanical performance curve.
Figure 1:
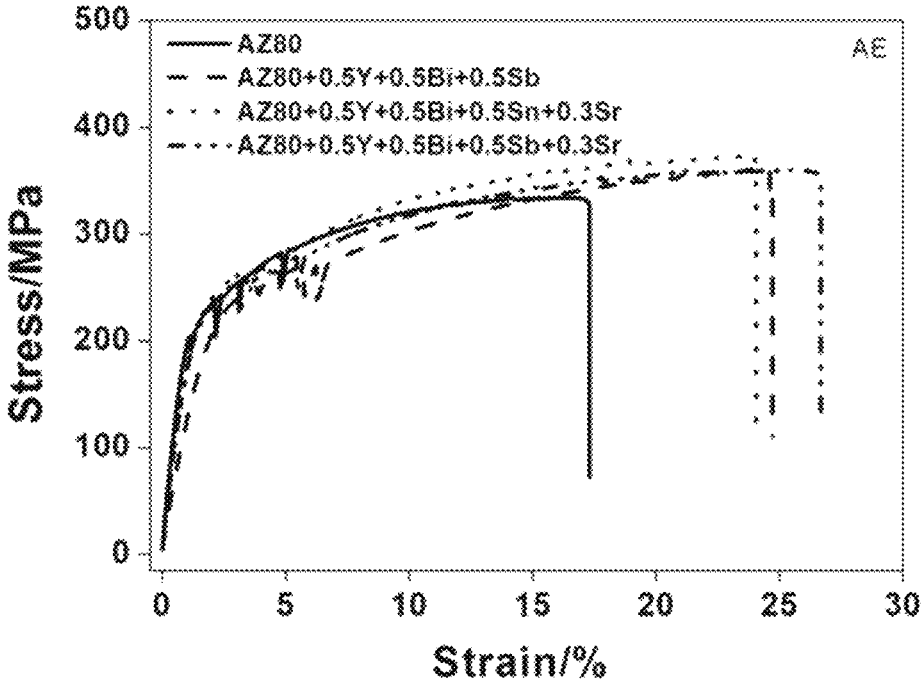

The present disclosure will be further described below with specific implementation modes. The following embodiments are all implemented on the premise of the technical solution of the present disclosure, and detailed implementation modes and specific operation processes are given, but the protection scope of the present disclosure is not limited to the following embodiments.

Three alloy compositions are selected as typical examples:

Mg-7Al-0.6Bi-0.3Sb-0.2Zn-0.1Sr-0.05Y-0.08Mn (wt %) (alloy 1),

Mg-8Al-0.7Bi-0.35b-0.3Zn-0.1Sr-0.05Y-0.09Mn (wt %) (alloy 2), and

Mg-8.5Al-0.8Bi-0.65b-0.4Zn-0.1Sr-0.04Y-0.08Mn (wt %) (alloy 3).

Embodiment 1

1) raw materials are weighed according to the mass percentage of the alloy Mg-7A1-0.6Bi-0.3Sb-0.2Zn-0.1Sr-0.05Y-0.08Mn (wt %): a pure Mg ingot, a pure Al block, a pure Bi block, a pure Sb block, a pure Zn block, a Mg-30Y intermediate alloy, a Mg-20Sr intermediate alloy and a Mg-10Mn intermediate alloy are the raw materials, and surface treatment is performed on the raw materials;

2) the pure Mg ingot is put into a crucible of a smelting furnace; a furnace temperature is set at 715° C. and then maintained; the pure Al block, the pure Bi block, the pure Sb block, the pure Zn block, the Mg-30Y intermediate alloy, the Mg-20Sr intermediate alloy and the Mg-10Mn intermediate alloy are respectively added into the magnesium melt after the pure Mg ingot is melted; then the melting temperature is increased by 30° C. and maintained for 10 minutes; the mixture is stirred for 5 minutes; the furnace temperature is reduced by 20° C. for refining and degassing treatment; and then standing for heat preservation is performed for 15 minutes, in which the whole process is performed under the protection of CO2/SF6 mixed gas;

3) casting is performed: dross is removed from the surface of the melt, and the magnesium alloy melt is poured into a cylindrical mold having a diameter of 60 mm by adopting a gravity casting mode to obtain an as-cast magnesium alloy bar, in which the casting process requires no gas protection;

4) solution treatment is performed: solution treatment is performed on the obtained as-cast magnesium alloy at a solution treatment temperature of 420° C. for 8 hours, and the alloy is quenched with warm water of 50° C., in which the heating and heat preservation processes of the solution treatment require no gas protection;

5) aging treatment is performed: aging treatment is performed on the alloy subjected to the solution treatment, and the temperature is maintained at 200° C. for 8 hours; and 6) extrusion treatment is performed: the alloy obtained in the step 5) is extruded to deform: firstly, a cast ingot is cut into a corresponding blank, and the blank is peeled, and then the obtained blank is put into the mold for extrusion deformation treatment at an extrusion deformation speed of 2.3 m/min, an extrusion ratio of 36 and an extrusion temperature of 300° C., in which the deformed blank should be heated to the required extrusion temperature within 30 minutes; and after the extrusion is ended, the alloy is cooled at a room temperature.

Finally, the alloy treated in the step 5) and the step 6) is tested for mechanical properties (a room temperature test method of Part 1 of GB/T 228.1-2010 Metal Material Tensile Test and a GB/T 7314-2005 metal material room temperature compression test method are adopted) until the alloy is broken by pulling (pressing), and a stress-strain curve is obtained, as shown in FIG. 1.

Embodiment 2

1) raw materials are weighed according to the mass percentage of the alloy Mg-8A1-0.7Bi-0.3Sb-0.3Zn-0.1Sr-0.05Y-0.09Mn (wt %): a pure Mg ingot, a pure Al block, a pure Bi block, a pure Sb block, a pure Zn block, a Mg-30Y intermediate alloy, a Mg-20Sr intermediate alloy and a Mg-10Mn intermediate alloy are the raw materials, and surface treatment is performed on the raw materials;

2) the pure Mg ingot is put into a crucible of a smelting furnace; a furnace temperature is set at 715° C. and then maintained; the pure Al block, the pure Bi block, the pure Sb block, the pure Zn block, the Mg-30Y intermediate alloy, the Mg-20Sr intermediate alloy and the Mg-10Mn intermediate alloy are respectively added into the magnesium melt after the pure Mg ingot is melted; then the melting temperature is increased by 30° C. and maintained for 10 minutes; the mixture is stirred for 5 minutes; the furnace temperature is reduced by 20° C. for refining and degassing treatment; and then standing for heat preservation is performed for 15 minutes, in which the whole process is performed under the protection of CO2/SF6 mixed gas;

3) casting is performed: dross is removed from the surface of the melt, and the magnesium alloy melt is poured into a cylindrical mold having a diameter of 60 mm by adopting a gravity casting mode to obtain an as-cast magnesium alloy bar, in which the casting process requires no gas protection;

4) solution treatment is performed: solution treatment is performed on the obtained as-cast magnesium alloy at a solution treatment temperature of 420° C. for 8 hours, and the alloy is quenched with warm water of 50° C., in which the heating and heat preservation processes of the solution treatment require no gas protection;

5) aging treatment is performed: aging treatment is performed on the alloy subjected to the solution treatment, and the temperature is maintained at 200° C. for 8 hours; and 6) extrusion treatment is performed: the alloy obtained in the step 5) is extruded to deform: firstly, a cast ingot is cut into a corresponding blank, and the blank is peeled, and then the obtained blank is put into the mold for extrusion deformation treatment at an extrusion deformation speed of 2.3 m/min, an extrusion ratio of 36 and an extrusion temperature of 300° C., in which the deformed blank should be heated to the required extrusion temperature within 30 minutes; and after the extrusion is ended, the alloy is cooled at a room temperature.

Finally, the alloy treated in the step 5) and the step 6) is tested for mechanical properties (a room temperature test method of Part 1 of GB/T 228.1-2010 Metal Material Tensile Test and a GB/T 7314-2005 metal material room temperature compression test method are adopted) until the alloy is broken by pulling (pressing), and a stress-strain curve is obtained, as shown in FIG. 1.

Embodiment 3

1) raw materials are weighed according to the mass percentage of the alloy Mg-8.5A1-0.8Bi-0.6Sb-0.4Zn-0.1Sr-0.04Y-0.08Mn (wt %): a pure Mg ingot, a pure Al block, a pure Bi block, a pure Sb block, a pure Zn block, a Mg-30Y intermediate alloy, a Mg-20Sr intermediate alloy and a Mg-10Mn intermediate alloy are the raw materials, and surface treatment is performed on the raw materials;

2) the pure Mg ingot is put into a crucible of a smelting furnace; a furnace temperature is set at 715° C. and then maintained; the pure Al block, the pure Bi block, the pure Sb block, the pure Zn block, the Mg-30Y intermediate alloy, the Mg-20Sr intermediate alloy and the Mg-10Mn intermediate alloy are respectively added into the magnesium melt after the pure Mg ingot is melted; then the melting temperature is increased by 30° C. and maintained for 10 minutes; the mixture is stirred for 5 minutes; the furnace temperature is reduced by 20° C. for refining and degassing treatment; and then standing for heat preservation is performed for 15 minutes, in which the whole process is performed under the protection of CO2/SF6 mixed gas;

3) casting is performed: dross is removed from the surface of the melt, and the magnesium alloy melt is poured into a cylindrical mold having a diameter of 60 mm by adopting a gravity casting mode to obtain an as-cast magnesium alloy bar, in which the casting process requires no gas protection;

4) solution treatment is performed: solution treatment is performed on the obtained as-cast magnesium alloy at a solution treatment temperature of 420° C. for 8 hours, and the alloy is quenched with warm water of 50° C., in which the heating and heat preservation processes of the solution treatment require no gas protection;

5) aging treatment is performed: aging treatment is performed on the alloy subjected to the solution treatment, and the temperature is maintained at 200° C. for 8 hours; and 6) extrusion treatment is performed: the alloy obtained in the step 5) is extruded to deform: firstly, a cast ingot is cut into a corresponding blank, and the blank is peeled, and then the obtained blank is put into the mold for extrusion deformation treatment at an extrusion deformation speed of 2.3 m/min, an extrusion ratio of 36 and an extrusion temperature of 300° C., in which the deformed blank should be heated to the required extrusion temperature within 30 minutes; and after the extrusion is ended, the alloy is cooled at a room temperature.

Finally, the alloy treated in the step 5) and the step 6) is tested for mechanical properties by adopting a room temperature test method of Part 1 of GB/T 228.1-2010 Metal Material Tensile Test and a GB/T 7314-2005 metal material room temperature compression test method until the alloy is broken by pulling (pressing), and a stress-strain curve is obtained, as shown in FIG. 1.

Reference example: an existing commercial magnesium alloy AZ80 is selected in the reference example and is obtained under the same processing conditions of the Embodiment 2.

The raw materials and equipment which are used in the aforementioned embodiments are all obtained by publicly known ways, and operation processes used are familiar to those skilled in the art.

FIG. 1 shows test results of relevant mechanical properties of the Examples 1, 2, 3 and reference example AZ80. The relevant mechanical properties are summarized in Table 1. The alloy of the present disclosure has the tensile strength of about 220 MPa, the yield strength of about 120 MPa and the elongation rate up to 10% in the T6 state, and has the tensile strength of about 370 MPa, the yield strength of about 205 MPa and the elongation rate of about 24% in the extruded state. The reference alloy has the tensile strength of 146 MPa, the yield strength of 93 MPa and the elongation rate of 3.54% in the T6 state, and has the tensile strength of 355 MPa, the yield strength of 184 MPa and the elongation rate of 17.3% in the extruded state. It can be seen from the comparison that the magnesium alloy of the present disclosure has an obvious improvement on yield strength, tensile strength and elongation rate in both T6 state and extruded state, and is a high-strength and high-toughness magnesium alloy material having market competitiveness.

Figure 2:
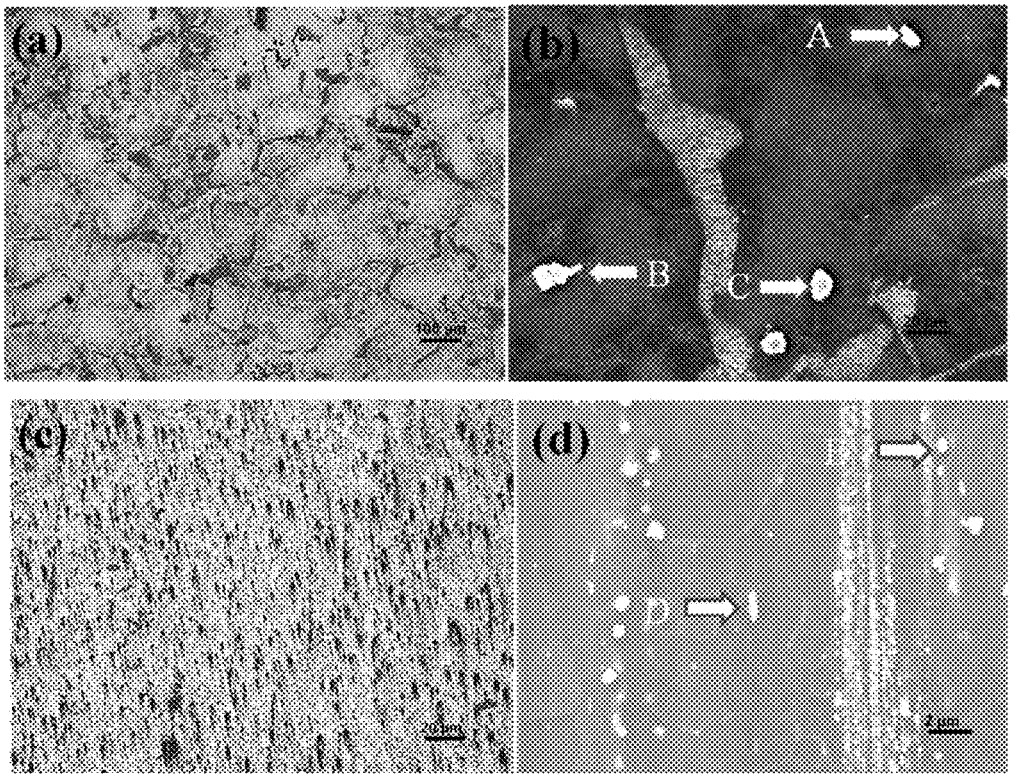
FIG. 2 is a microstructure of an alloy of Embodiment 1, in which panel (a) is T6-state OM tissue; panel (b) is T6-state SEM tissue; panel (c) is extruded-state OM tissue; and panel (d) is extruded-state SEM tissue.
Figure 3:
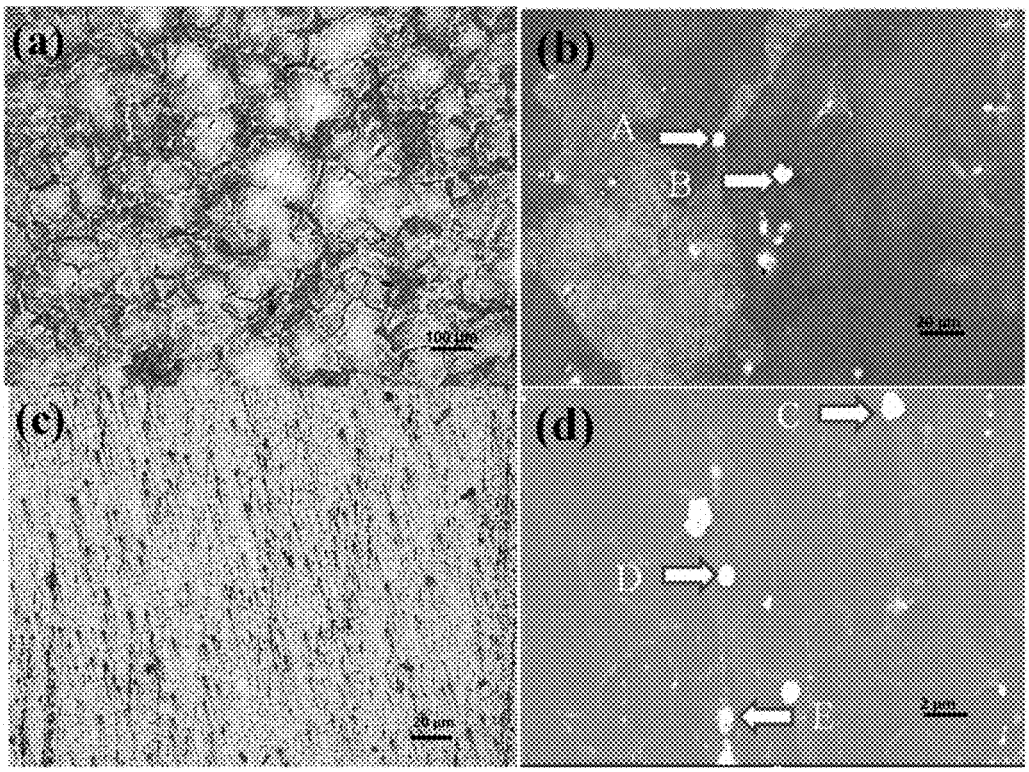
FIG. 3 is a microstructure of an alloy of Embodiment 2, in which panel (a) is T6-state OM tissue; panel (b) is T6-state SEM tissue; panel (c) is extruded-state OM tissue; and (d) is extruded-state SEM tissue.
Figure 4:
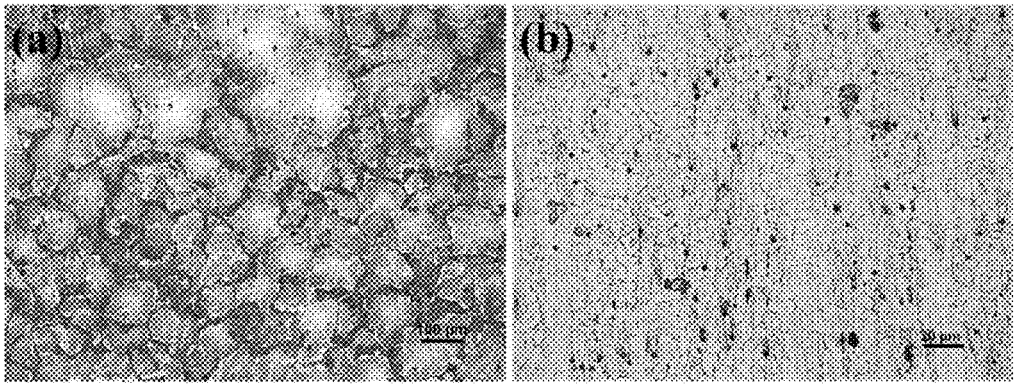
FIG. 4 is a microstructure of an alloy of Embodiment 3, in which panel (a) is T6-state OM tissue, and panel (b) is extruded-state OM tissue.
Figure 5:
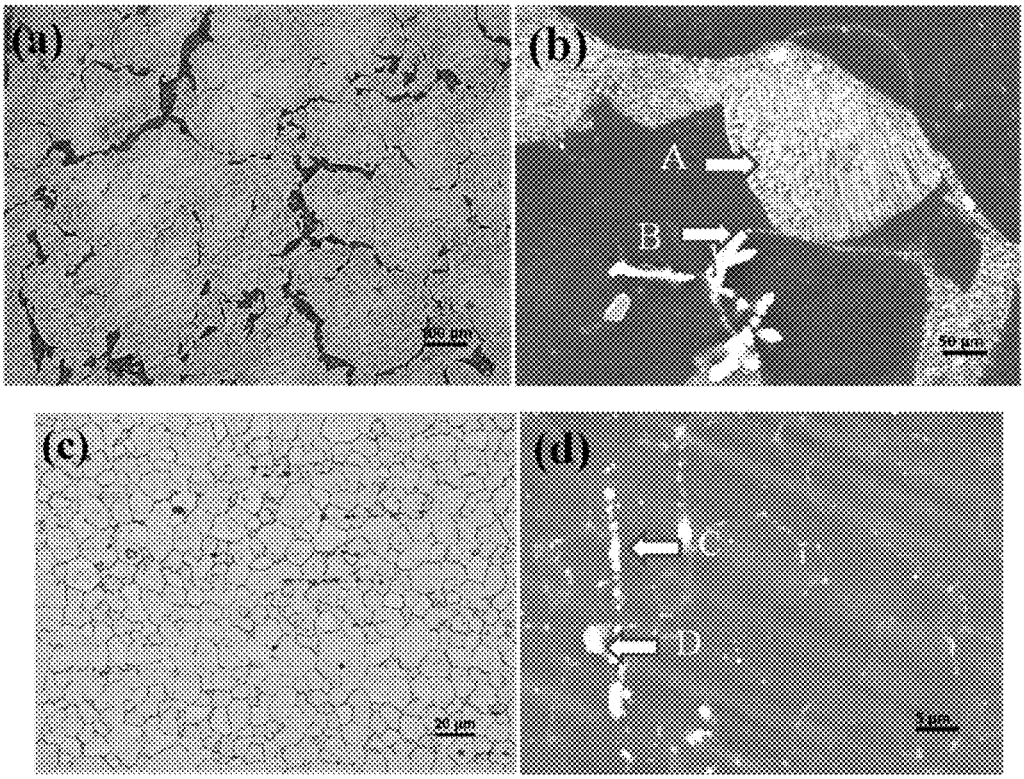
FIG. 5 is a microstructure of an alloy of a reference example, in which panel (a) is T6-state OM tissue; panel (b) is T6-state SEM tissue; panel (c) is extruded-state OM tissue; and panel (d) is extruded-state SEM tissue.

FIGS. 2-4 respectively show microstructures in different states of the Embodiment 1, Embodiment 2 and Embodiment 3, and FIG. 5 shows microstructures in different states of the reference example. It can be seen from comparison diagrams of 2a, 3a, 4a and 5a that after the composite microalloying, grains of the embodiments are remarkably refined, and the continuous coarse second phases in the as-cast microstructure of the reference example are converted into dispersion distribution, which weakens the splitting action on the matrix. This is also the reason for the improvement of the mechanical properties of the alloy of the present disclosure. Analysis of FIG. 2, panel (b), FIG. 3, panel (b) and FIG. 5, panel (b) shows that after being subjected to the T6 treatment, the alloys all have been subjected to aging precipitation; and the aged structure of the reference example shows that the aging precipitation second phases of the alloys of the embodiments are finer, indicating that the composite microalloying improves the aging precipitation behaviors of the alloys, which is consistent with the improvement of the properties of the T6-state alloy.

It can be seen from FIG. 2, panel (c), FIG. 3, panel (c), FIG. 4, panel (b) and FIG. 5, panel (c) that after being subjected to the extrusion treatment, the alloys all have undergone dynamic recrystallization, the recrystallized grains of the alloys of the present disclosure are finer, and the undissolved second phases are distributed along the extrusion direction. The presence of these undissolved phases may hinder the growth of alpha-Mg grains during the dynamic recrystallization. To determine the composition of the second phases, the Embodiments 1 and 2 and the reference example are selected for further EDS analysis. Results are shown in Table 2, Table 3 and Table 4. The EDS test results show that the second phases in stripe distribution in the alloy of the Embodiment 1 may include a phase rich in Al, Bi and Sb, a phase rich in Al and Sb and a phase rich in Al, Y and Mn, in addition to the Mg17A112 phase. In the Embodiment 2, a phase rich in Mg, Al and Y, a phase rich in Mg, Al and Mn and a phase rich in Mg, Al, Y and Mn appear, and meanwhile, there are Al and Sn elements dissolved in the matrix. These micron-sized second phases have a higher melting point and are difficultly dissolved into the matrix during the solution treatment, which may promote the dynamic recrystallization in the subsequent deformation process by means of particle-excited nucleation, thereby improving the comprehensive mechanical properties of the deformed alloy. The alloy of the reference example mainly includes Mg17Al12 with low thermal stability and a small amount of relatively large Al—Mn phase. This is consistent with the improvement of the strength and plasticity of the alloy of the present disclosure.

TABLE 1

Mechanical property test results of the Embodiments and the reference example at room temperature

| Example | Alloy composition (wt %) | Processing state | Yield strength MPa | Tensile strength MPa | Elongation rate % |
|---|---|---|---|---|---|
| Embodiment 1 | Mg—7Al—0.6Bi—0.3Sb—0.2Zn—0.1Sr—0.05Y—0.08Mn | AE | 201.4 | 361.4 | 24.7 |
| | | T6 | 120 | 210 | 6.31 |
| Embodiment 2 | Mg—8Al—0.7Bi—0.3Sb—0.3Zn—0.1Sr—0.05Y—0.09Mn | AE | 199.6 | 372.5 | 25.1 |
| | | T6 | 121 | 228 | 7.9 |
| Embodiment 3 | Mg—8.5Al—0.8Bi—0.6Sb—0.4Zn—0.1Sr—0.04Y—0.08Mn | AE | 209 | 359.5 | 24.6 |
| | | T6 | 118 | 231 | 10.73 |
| Reference example | AZ80 | AE | 184 | 335 | 17.3 |
| | | T6 | 93 | 146 | 3.54 |

TABLE 2

EDS analysis results of the alloy of the Embodiment 1

| Position | Mg | Al | Y | Mn | Bi | Sb | Corresponding phase |
|---|---|---|---|---|---|---|---|
| A | 50.34 | 6.66 | | | 20.79 | 22.21 | Al—Bi—Sb |
| B | 89.66 | 13.34 | | | | | $Mg_{17}Al_{12}$ |
| C | 88.51 | 8.61 | | | | 2.88 | Al—Sb |
| D | 88.74 | 9.96 | | | | 1.30 | Al—Sb |
| E | 16.84 | 32.66 | 49.63 | 0.86 | | | Al—Y—Mn |

TABLE 3

EDS analysis results of the alloy of the Embodiment 2

| Position | Mg | Al | Y | Mn | Sn | Correpsonding phase |
|---|---|---|---|---|---|---|
| A | 55.14 | 23.26 | 21.29 | 0.28 | | Mg—Al—Y |
| B | 70.15 | 20.39 | | 9.46 | | Mg—Al—Mn |
| C | 6.14 | 37.66 | 46.76 | 9.47 | | Mg—Al—Y—Mn |
| D | 89.81 | 9.10 | | | 1.09 | Mg—Al—Sn |
| E | 89.51 | 8.91 | | | 1.58 | Mg—Al—Sn |

TABLE 4

EDS analysis results of the AZ80 alloy

| Position | Mg | Al | Mn | Correpsonding phase |
|---|---|---|---|---|
| A | 91.07 | 8.93 | | $Mg_{17}Al_{12}$ |
| B | 90.64 | 9.36 | | $Mg_{17}Al_{12}$ |
| C | 23.02 | 48.49 | 28.49 | Al—Mn |
| D | 49.94 | 30.19 | 19.87 | Al—Mn |

The invention claimed is:

1. A preparation method of a magnesium alloy, comprising:

1) performing mixing: mixing a pure Mg ingot, a pure Al block, a pure Bi block, a pure Sb block, a pure Zn block, a Mg-Y intermediate alloy, a Mg-Sr intermediate alloy and a Mg-Mn intermediate alloy which serve as raw materials according to a magnesium alloy composition;

2) performing smelting: putting the pure Mg ingot into a crucible of a smelting furnace, setting a furnace temperature at 700 to 730° C., maintaining the temperature, and respectively adding the pure Bi block, the pure Sb block and the pure Zn block which are preheated to 50 to 100° C., the Mg-Sr intermediate alloy, the Mg-Y intermediate alloy and the Mg-Mn intermediate alloy which are preheated to 200 to 250° C. into the magnesium melt after the pure Mg ingot is melted; then increasing the smelting temperature by 20 to 40° C., and maintaining the temperature for 5 to 15 minutes, then stirring the mixture for 3 to 10 minutes, reducing the furnace temperature by 10 to 30° C. for refining and degassing treatment, and then standing for heat preservation for 3 to 15 minutes, wherein the whole process is performed under the protection of $CO_2/SF_6$ mixed gas;

3) performing casting: removing dross from the surface of the melt, and pouring the magnesium alloy melt into a corresponding mold to obtain an as-cast magnesium alloy, wherein no gas protection is performed during the casting;

4) performing solution treatment: performing solution treatment on the obtained as-cast magnesium alloy at a solution treatment temperature of 415 to 440° C. for 6 to 10 hours, and quenching the alloy with warm water of 30 to 80° C., wherein no gas protection is performed during the heating and heat preservation processes of the solution treatment;

5) performing aging treatment: performing aging treatment on the alloy subjected to the solution treatment, and maintaining the temperature at 175 to 200° C. for 8 to 15 hours; and 6) performing extrusion treatment: extruding the alloy obtained in the step 5) to deform: firstly, cutting a cast ingot into a corresponding blank, and peeling the blank, and then putting the obtained blank into the mold for extrusion deformation treatment at an extrusion deformation speed of 1 to 2.8 m/min, an extrusion ratio of 10 to 50 and an extrusion temperature of 250 to 400° C., wherein the deformed blank is heated to the required extrusion temperature within 30 minutes;

and after the extrusion is ended, cooling the alloy at a room temperature.

2. The preparation method of claim 1, wherein the magnesium alloy composition comprises in percentage by mass: 7.0 to 10.0% of Al, 0.2 to 2.0% of Bi, 0.2 to 0.8% of Sb, 0.2 to 0.5% of Zn, 0.1 to 0.5% of Sr, 0.03 to 0.3% of Y, 0.05 to 0.1% of Mn and a balance of Mg.

* * * * *